US008280294B2

(12) United States Patent
Tanaka

(10) Patent No.: US 8,280,294 B2
(45) Date of Patent: Oct. 2, 2012

(54) CLEANING DEVICE FOR AN IMAGE FORMING UNIT

(75) Inventor: Kuniaki Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 348 days.

(21) Appl. No.: 12/698,249

(22) Filed: Feb. 2, 2010

(65) Prior Publication Data

US 2011/0064495 A1 Mar. 17, 2011

(30) Foreign Application Priority Data

Sep. 15, 2009 (JP) ..... 2009-212692

(51) Int. Cl.
*G03G 21/00* (2006.01)

(52) U.S. Cl. ..... 399/349; 399/123; 399/264; 399/283; 399/353; 399/357; 399/358

(58) Field of Classification Search ..... 399/123, 399/264, 283, 349, 353, 357, 358
See application file for complete search history.

(56) References Cited

U.S. PATENT DOCUMENTS

2003/0152407 A1* 8/2003 Hatano ..... 399/358
2006/0204297 A1* 9/2006 Honda et al. ..... 399/349
2006/0257175 A1* 11/2006 Endo et al. ..... 399/283

FOREIGN PATENT DOCUMENTS

JP 5-88589 A 4/1993
JP 2006-84878 A 3/2006
JP 2008-276251 A 11/2008

* cited by examiner

*Primary Examiner* — Ryan Walsh
(74) *Attorney, Agent, or Firm* — Sughrue Mion, PLLC

(57) ABSTRACT

A cleaning device includes a rotary member that contacts with an image carrier and moves materials on a surface of the image carrier along a rotation direction of the rotary member; a scraping member that contacts with the rotary member to scrape the materials adhering on the rotary member; a collected material receiving portion disposed downstream of a contact portion of the rotary member and the scraping member in a gravity direction; plural openings provided along a width direction of the image carrier by a partition member, through which the materials scraped by the scraping member pass to the collected material receiving portion; a protrusion portion that is arranged between the openings and the contact portion of the rotary member and the scraping member, and protrudes toward an upstream side in a rotation direction of the rotary member.

9 Claims, 7 Drawing Sheets

CLEANING DEVICE FOR AN IMAGE FORMING UNIT

CROSS-REFERENCE TO RELATED APPLICATIONS

This application is based on and claims priority under 35 USC 119 from Japanese Patent Application No. 2009-212692 filed on Sep. 15, 2009.

BACKGROUND

Technical Field

The present invention relates to a cleaning device, an image forming unit, and an image forming apparatus.

SUMMARY

According to an aspect of the invention, there is provided a cleaning device including: a rotary member that rotates in contact with an image carrier and moves materials on a surface of the image carrier along a rotation direction of the rotary member; a scraping member that contacts with the rotary member to scrape the materials adhering onto the rotary member, the scraping member having a plurality of openings provided along an axial direction of the image carrier, through which the materials scraped by the scraping member pass to a collected material receiving portion; the collected material receiving portion that receives the materials passed through the openings, when it is assumed that a surface that passes through a contact portion of the rotary member and the scraping member and is parallel to a gravity direction is a reference surface, the reference surface being disposed between a contact portion of the image carrier and the rotary member, and the collected material receiving portion; and a protrusion portion that is arranged between the openings and the contact portion of the rotary member and the scraping member, and protrudes toward an upstream side in a rotation direction of the rotary member from the reference surface, and be positioned on an upper side in the gravity direction of the contact portion of the rotary member and the scraping member.

BRIEF DESCRIPTION OF THE DRAWINGS

An exemplary embodiment of the invention will be described in detail based on the following figures, wherein.

DETAILED DESCRIPTION

Hereinafter, an exemplary embodiment of the invention will be described with reference to the drawings.

Figure 1:
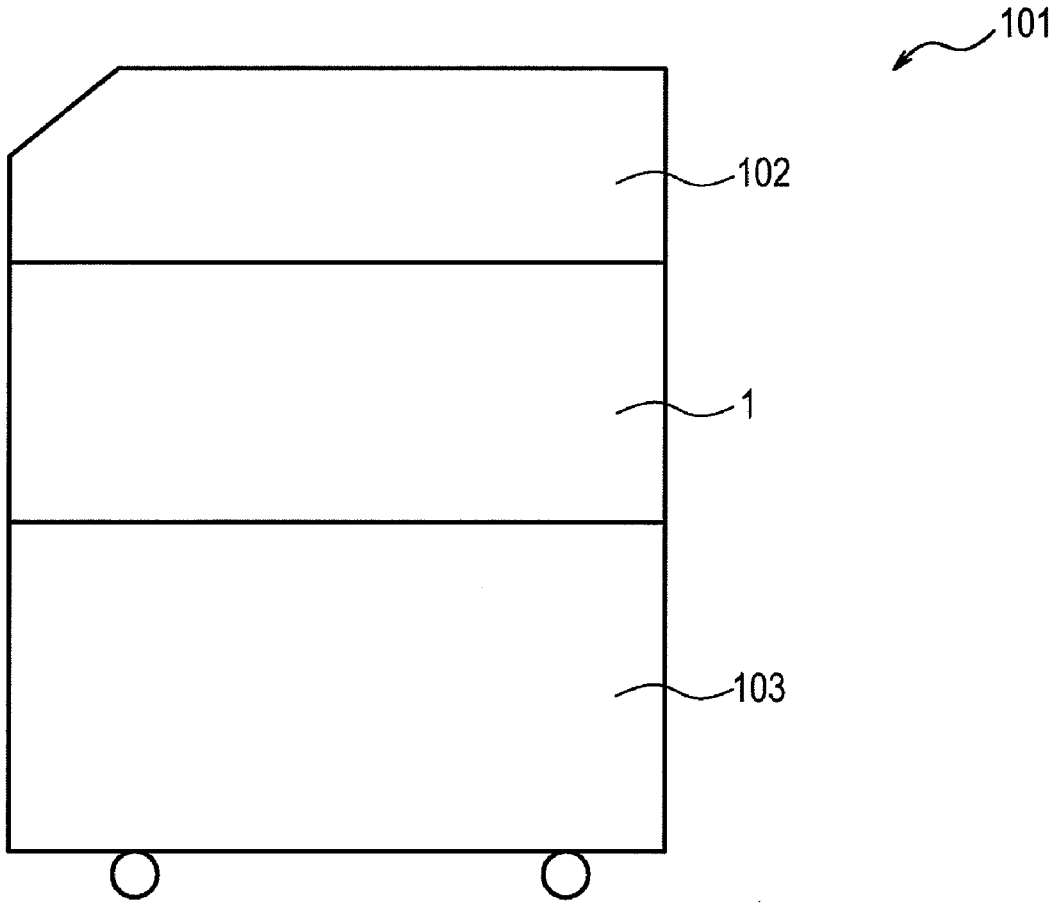
FIG. 1 is an explanatory view showing the overall configuration of an image forming apparatus according to an exemplary embodiment of the invention.

FIG. 1 is an explanatory view of an image forming apparatus according to this exemplary embodiment.

An image forming apparatus 101 includes a printer engine 1 that forms an image on a print medium, such as a sheet or the like, by an electrophotographic method, a scanner 102 that reads an image of an original document, a sheet feed cassette 103 that accommodates sheets to be fed to the printer engine 1, and the like.

Figure 2:
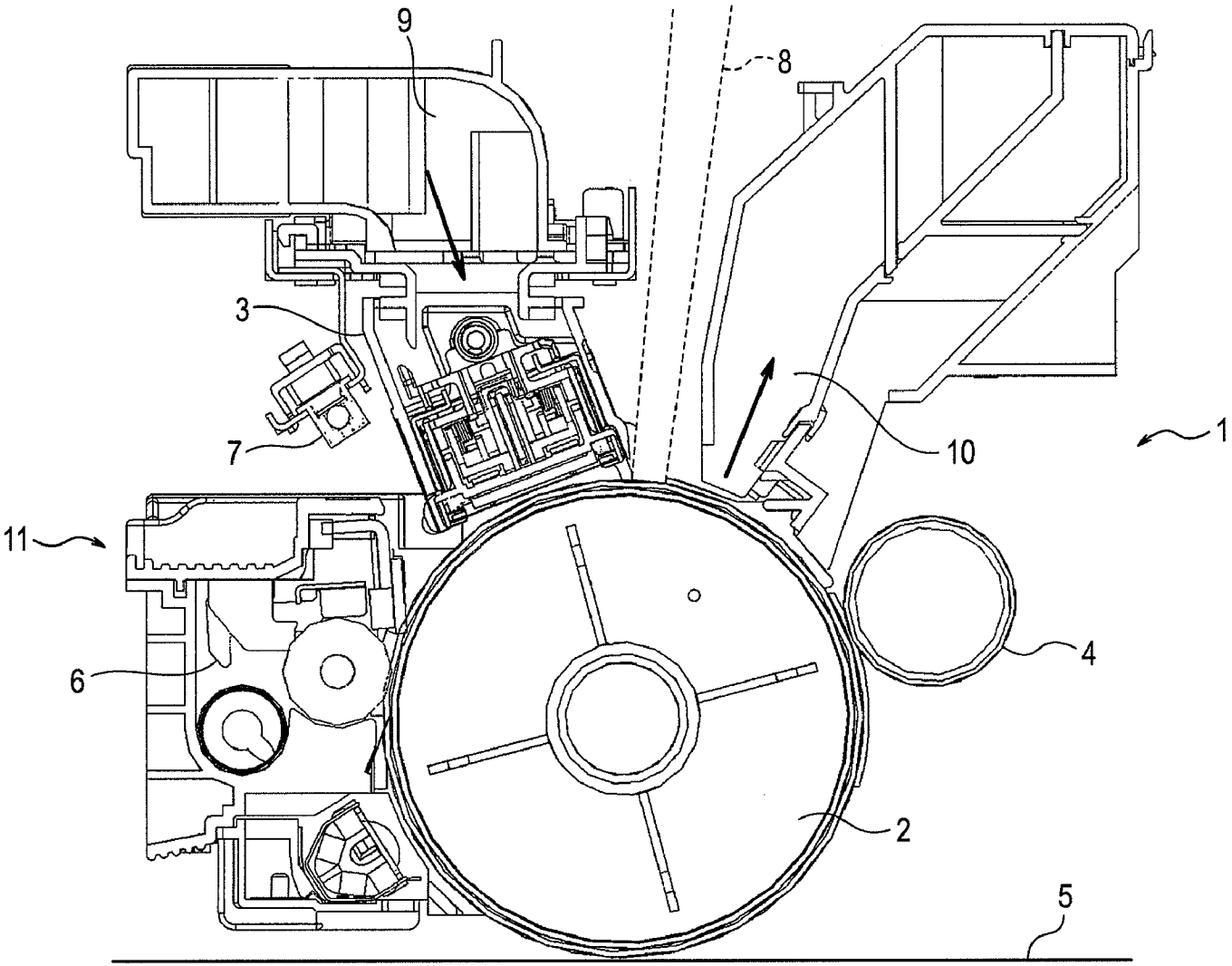
FIG. 2 is a longitudinal sectional view of a printer engine of the image forming apparatus according to the exemplary embodiment of the invention.

FIG. 2 is a longitudinal sectional view of the printer engine of the image forming apparatus according to this exemplary embodiment.

The printer engine 1 includes a photoconductor drum 2 that is an example of an image holding member. Around the photoconductor drum 2 are arranged various devices for image formation by an electrophotographic process, for example, a charger 3 that charges the photoconductor drum 2, a (roller of) developing unit 4 that develops an electrostatic latent image on the photoconductor drum 2 by toner, a transfer belt 5 that transfers a toner image on the photoconductor drum 2 to a print medium, a cleaning device 6 serving as a toner cleaning device that cleans residual toner on the toner photoconductor drum 2, an eraser 7 that erases residual charge on the photoconductor drum 2, and the like. Reference numeral 8 denotes exposure light that is emitted from an exposure device (not shown) to form an electrostatic latent image on the photoconductor drum 2. An air intake duct 9 and an air exhaust duct 10 discharges ozone inside the image forming apparatus 101.

Of the respective devices for an electrophotographic process, some devices, including the photoconductor drum 2 and the cleaning device 6, form an image forming unit 11 that is a cartridge capable of being freely attached to and detached from the main body of the image forming apparatus 101.

Next, the cleaning device 6 will be described in detail.

Figure 3:
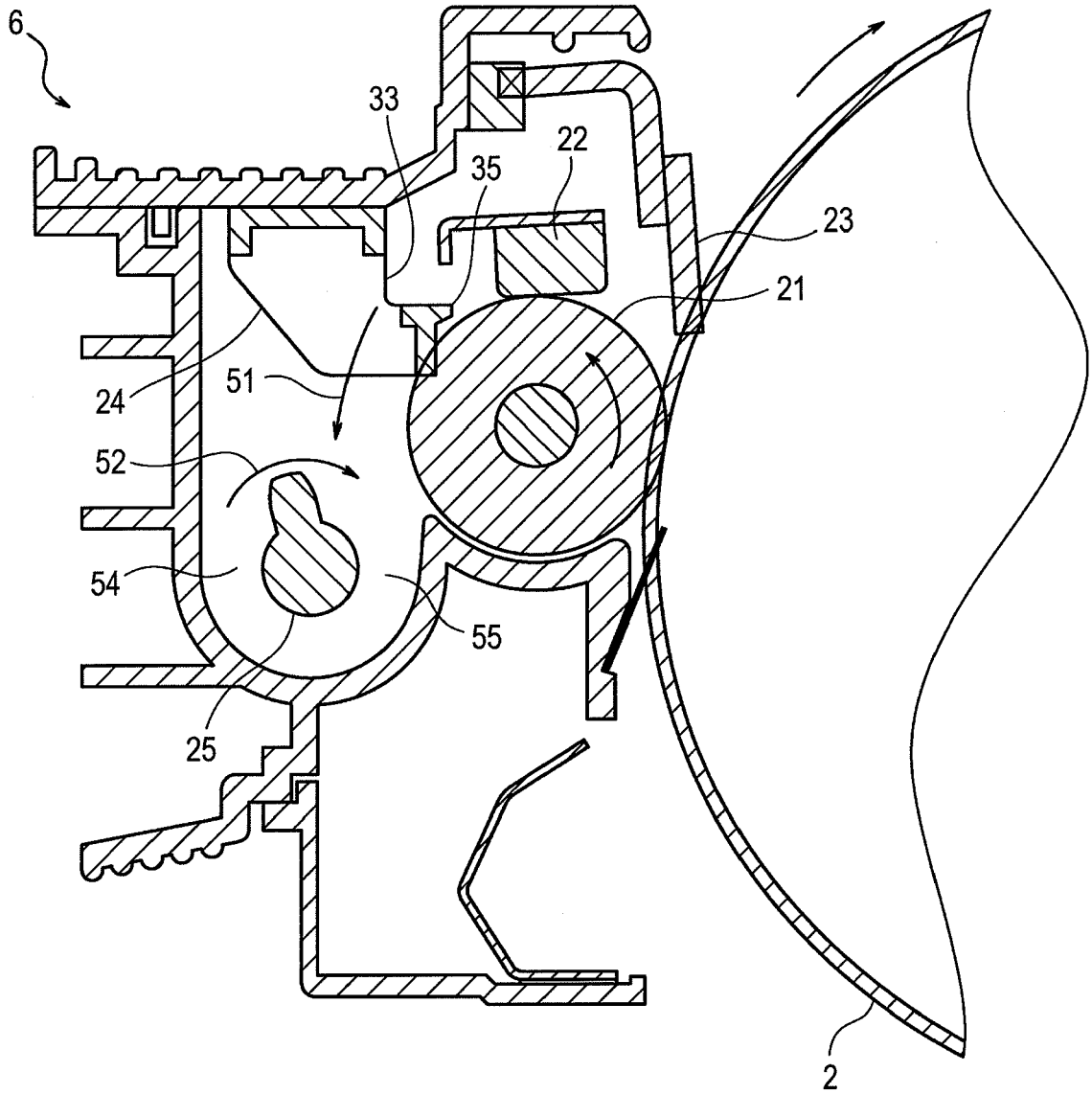
FIG. 3 is a longitudinal sectional view of a cleaning device of the image forming apparatus according to the exemplary embodiment of the invention.
Figure 4:
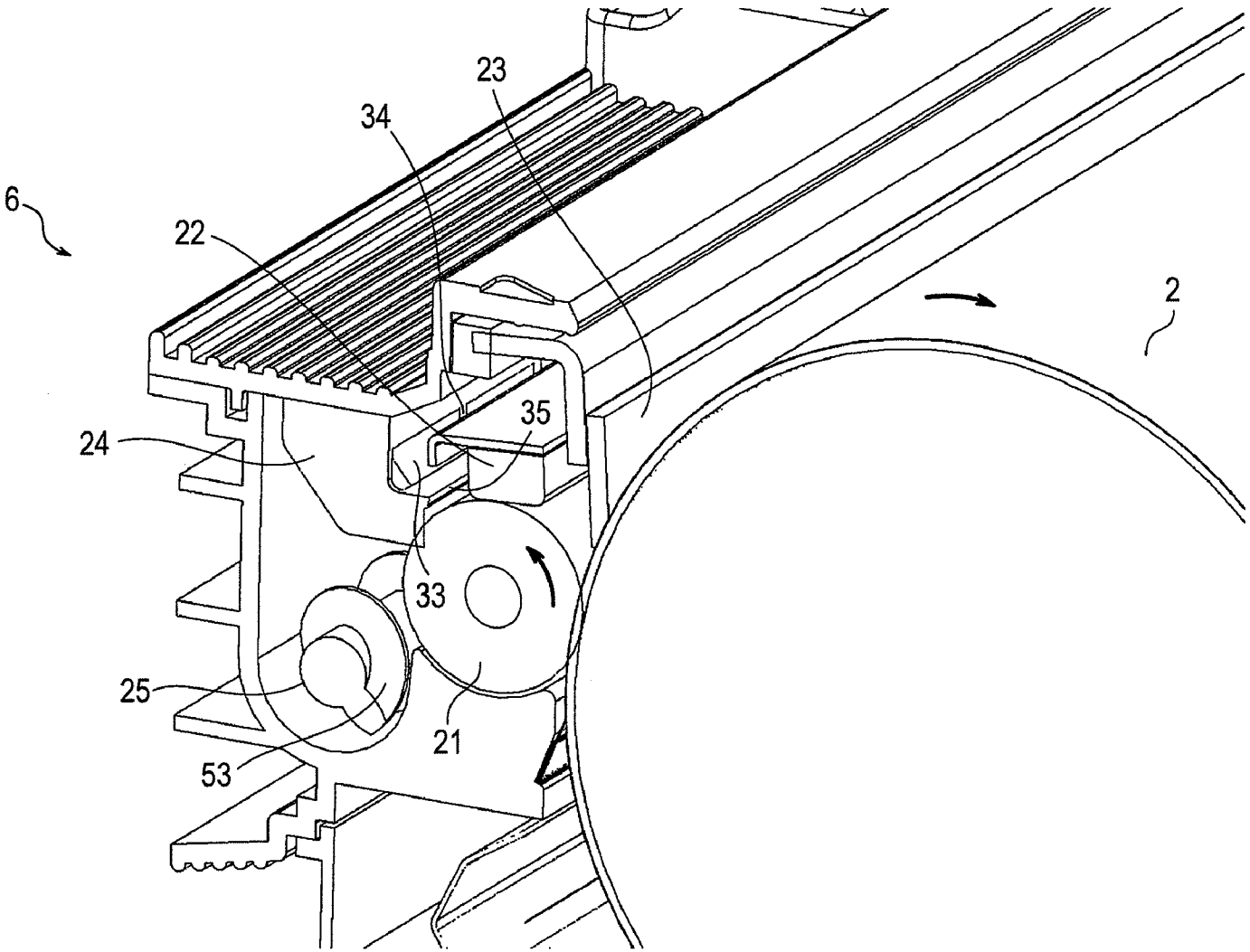
FIG. 4 is a perspective view of the cleaning device of the image forming apparatus according to the exemplary embodiment of the invention.

FIG. 3 is a longitudinal sectional view of the cleaning device 6. FIG. 4 is a perspective view of the cleaning device 6.

The cleaning device 6 cleans adhered materials on the photoconductor drum 2 after a toner image is transferred to a print medium. The adhered materials includes residual developer (toner and an outer additive), a foreign substance, such as paper dust adhering onto the photoconductor drum 2 from a sheet serving as a recording medium, a lubricant applied onto the photoconductor drum 2 through a cleaning brush 21 described below, and the like. The cleaning brush 21 is a roller-like member that is an example of a rotary member, and rotates in a counterclockwise direction as indicated by an arrow of FIG. 2 while being in contact with the surface of the photoconductor drum 2 (the photoconductor drum 2 rotates in a clockwise direction as indicated by an arrow of FIG. 2). The cleaning brush 21 floats the adhered matter on the photoconductor drum 2 to be easily removed. A lubricant 22 is supplied to the surface of the cleaning brush 21.

A cleaning blade 23 is a blade-like member that realizes a first removing member and contacts with the surface of the photoconductor drum 2. The cleaning blade 23 scrapes and removes the adhered matter on the photoconductor drum 2 floated by the cleaning brush 21.

A flicker 24 that is an example of a scraping member comes into contact with the surface of the cleaning brush 21 by the front edge. The flicker 24 scrapes toner adhering onto the surface of the cleaning brush 21.

A toner collection auger 25 is provided below the flicker 24. The toner collection auger 25 rotates to collect toner removed by the flicker 24 and to transport the collected toner along the rotation shaft thereof.

Next, details of the flicker 24 will be described.

Figure 5:
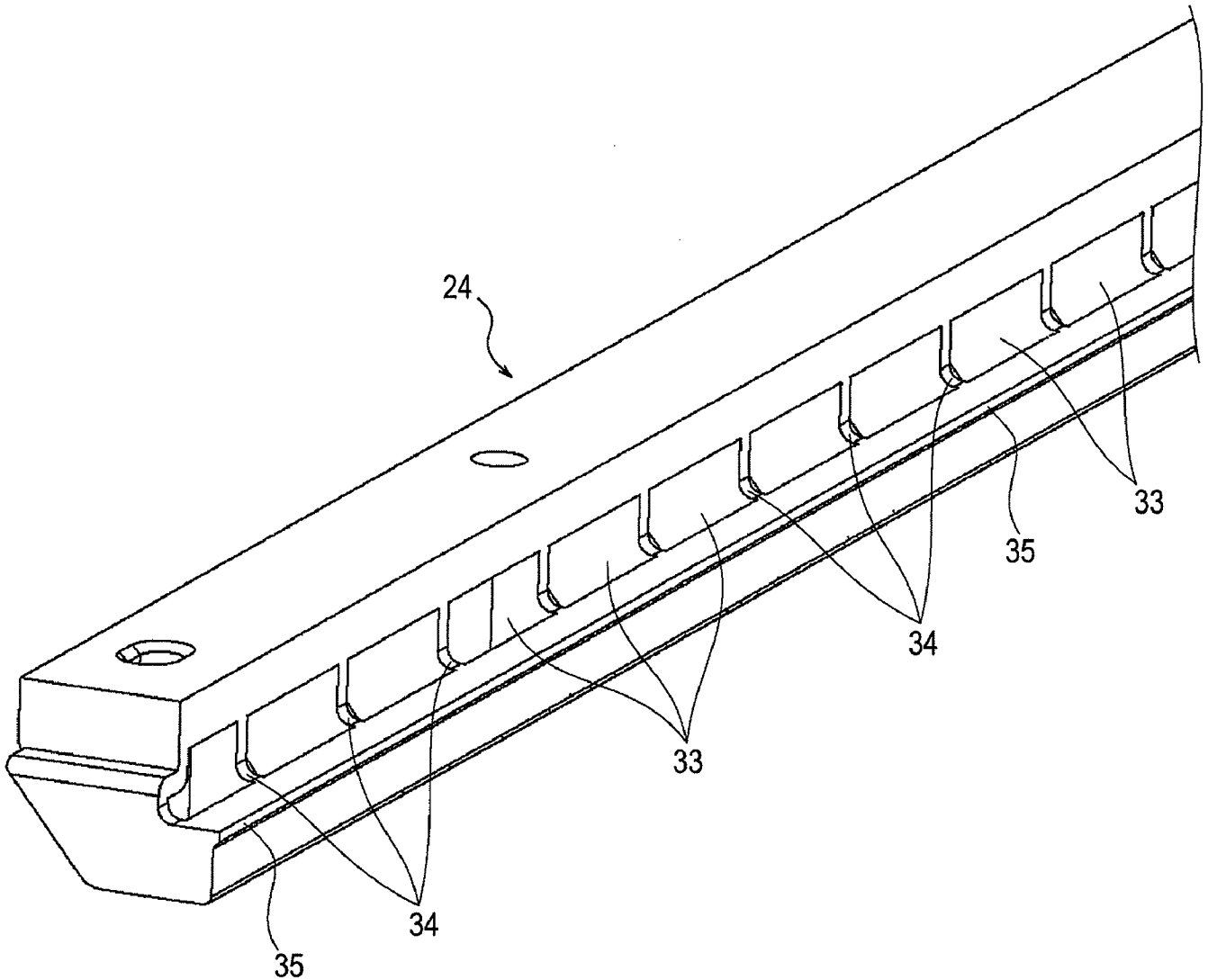
FIG. 5 is a perspective view of part of a flicker of the image forming apparatus according to the exemplary embodiment of the invention when viewed obliquely from above.
Figure 6:
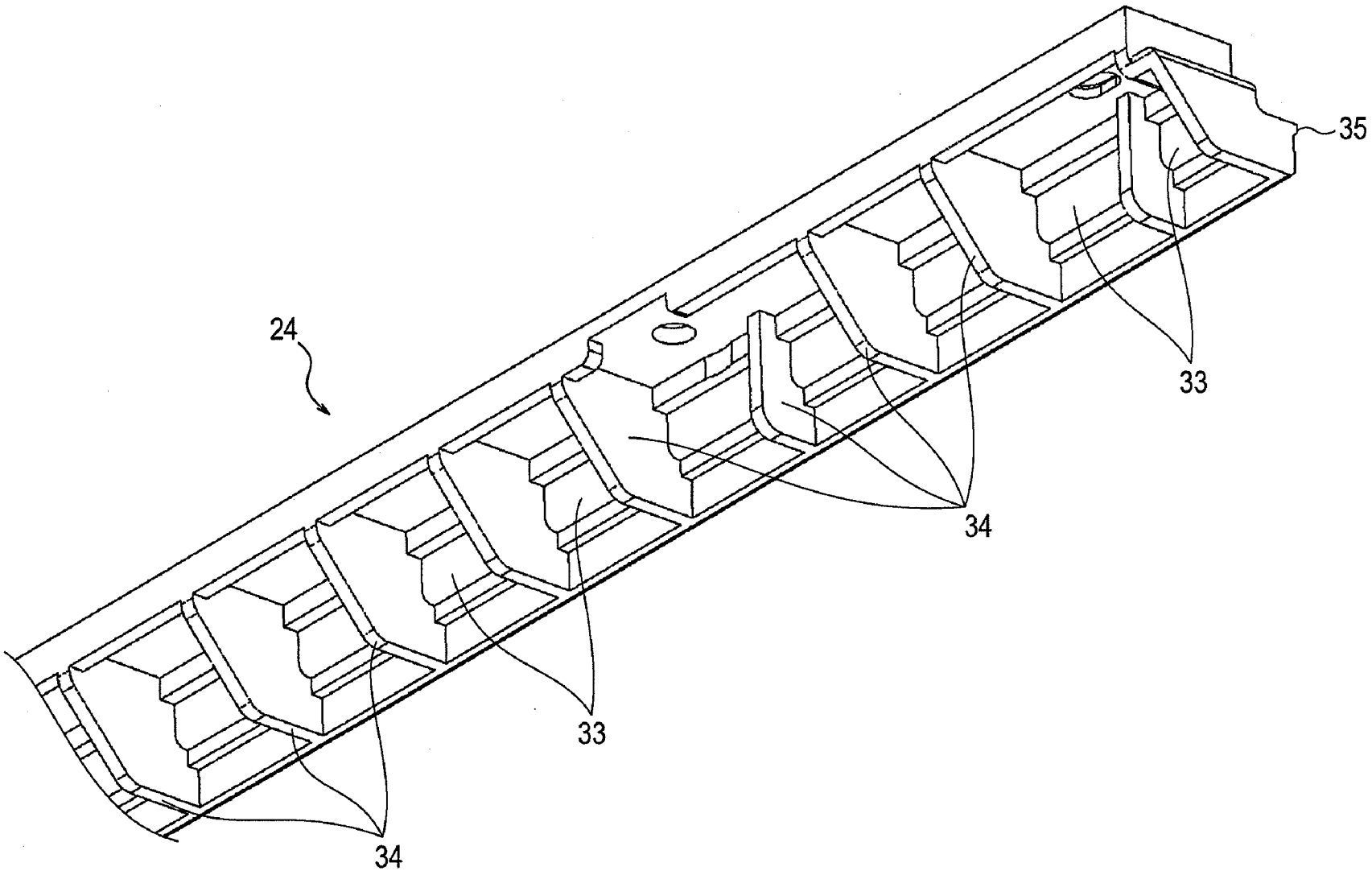
FIG. 6 is a perspective view of part of the flicker of the image forming apparatus according to the exemplary embodiment of the invention when viewed obliquely from below.
Figure 7:
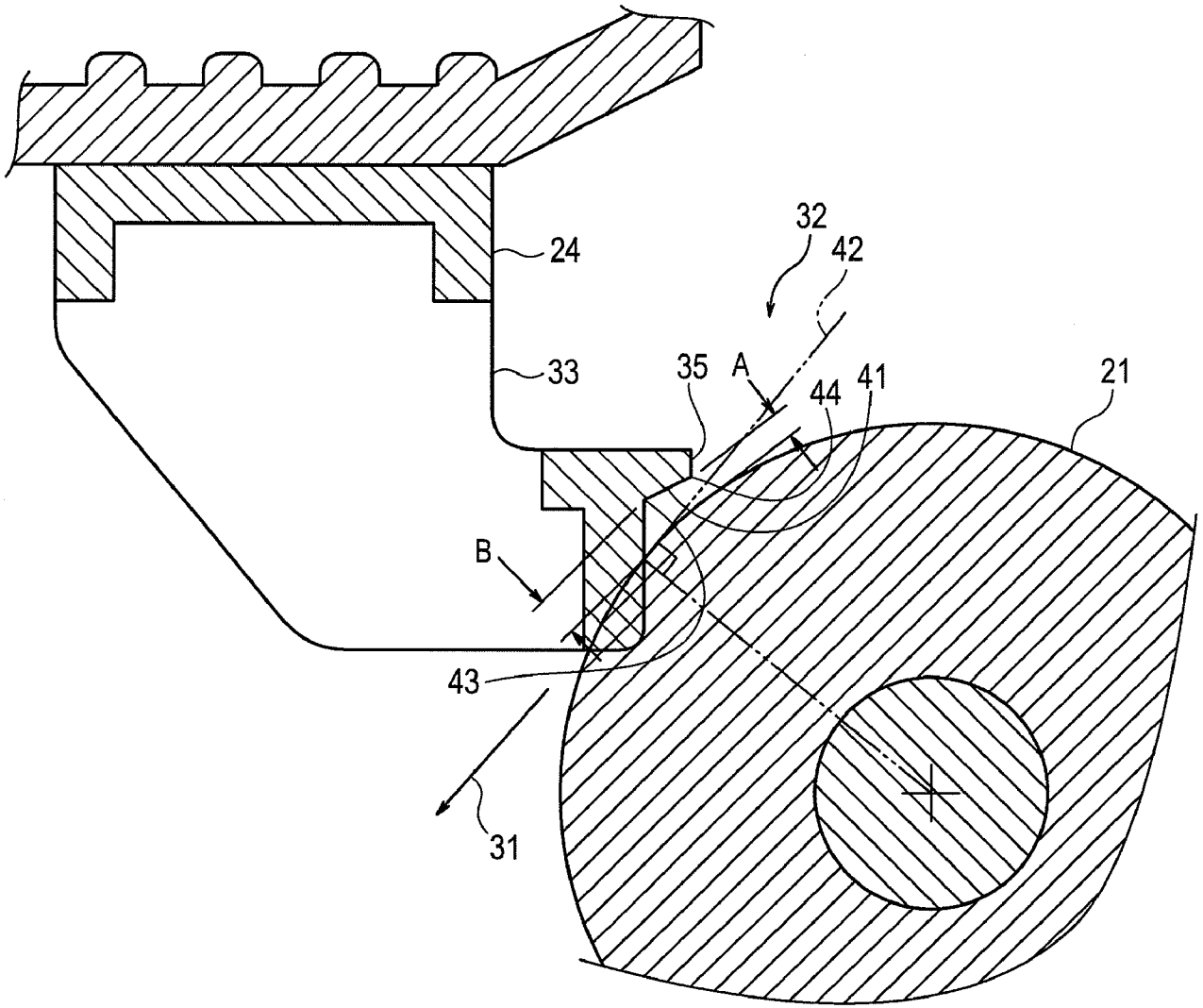
FIG. 7 is an enlarged sectional view of a contact portion of a cleaning brush and a flicker in the image forming apparatus according to the exemplary embodiment of the invention.

FIG. 5 is a perspective view of part of the flicker 24 when viewed obliquely from above. FIG. 6 is a perspective view of part of the flicker 24 when viewed obliquely from below. FIG. 7 is an enlarged sectional view of a contact portion of the cleaning brush 21 and the flicker 24.

By the effect of the flicker 24, toner flicking from the cleaning brush 21 flies in a direction of an arrow 31. At a portion denoted by reference numeral 32 between the cleaning brush 21 and the flicker 24, toner after being removed is gradually deposited. If the amount of toner accumulated at the portion denoted by reference numeral 32 excessively increases, the toner cleaning state is defective. In particular, in a certain image forming apparatus 101, a large amount of toner is supplied onto the photoconductor drum 2, and accordingly the amount of toner to be removed by the cleaning device 6. In this case, a large amount of toner is accumulated at the position denoted by reference numeral 32, and a defective toner cleaning state is likely to occur.

The flicker 24 is provided with plural openings 33. The openings 33 are formed to be arranged along the rotation shaft direction of the cleaning brush 21. Adjacent openings 33 are partitioned by a rib 34, which is an example of a partition member. Toner deposited at the position denoted by reference numeral 32 between the cleaning brush 21 and the flicker 24 is tumbled down from the openings 33 and falls down toward the toner collection auger 25.

In this example, since the flicker 24 is formed of resin, in order to make the flicker 24 and the openings have such a strength as to be not deformed, plural ribs 34 are provided along the longitudinal direction of the openings 33, such that portions in the vicinity of the openings 33 are strengthened. For example, the amount of toner collected in the axial direction of the photoconductor drum 2 may differ, so when the shape and size of the openings 33 are changed in accordance with the amount of toner to be collected, the ribs 34 may be provided for reasons other than strength such that the ribs 34 are disposed at the boundary.

However, since the cleaning brush 21 rotates to cause toner to fly, the toner that comes into contact with the cleaning brush 21 move along the rotation direction of the cleaning brush 21, and toner deposited at the portion denoted by reference numeral 32 flies by the cleaning brush 21. If toner flies at the positions where the openings 33 are formed, toner passes through the openings 33 and falls down toward the toner collection auger 25. In this case, when no countermeasure is taken, if toner files at the positions where the ribs 34 are formed, not the openings 33, toner is bounced back by the ribs 34 and clumps on the cleaning brush 21 at portions corresponding to the positions of the ribs 34. This causes variations in the amount of toner at the contact portion of the cleaning brush 21 and the flicker 24 by certain portions of the ribs 34 and the portions where the openings 33 are formed. Further, the portions where the ribs 34 are present come into contact with the photoconductor drum 2 with a large amount of toner, which results in deterioration in cleaning performance. The deterioration in cleaning performance affects an image formed by the photoconductor drum 2.

Therefore, the flicker 24 is provided with a protrusion 35 as an example of a protrusion to correspond to each of the positions where the openings 33 and the ribs 34 are formed. The protrusion 35 is arranged between the portion where the flicker 24 comes into contact with the cleaning brush 21 and the openings 33 and the ribs 34. The protrusion 35 protrudes from the flicker 24 toward the upstream side in the rotation direction with respect to a surface parallel to the gravity direction through the contact portion of the flicker 24 and the cleaning brush 21. The flicker 24 prevents toner scraped by the cleaning brush 21 from flying at the positions where the openings 33 and the ribs 34 are arranged. That is, toner flying from the cleaning brush 21 is blocked by a lower surface 41 of the protrusion 35. The protrusion 35 reduces variations in the amount of toner in the vicinity of the contact portion of the flicker 24 and the cleaning brush 21 between the portions where the openings 33 are arranged and the portions where the ribs 34 are arranged.

In order to allow toner to easily remain at the tail end 43 of the protrusion 35 between the flicker 24 and the cleaning brush 21, thereby effectively preventing scattering of toner, at a portion where the flicker 24 comes into contact with the cleaning brush 21, an angle between a tangential line 42 on the surface of the cleaning brush 21 and the lower surface 41 which is the surface of the protrusion 35 facing the cleaning brush 21 is an acute angle. As a result, between the protrusion 35 and the flicker 24, a gap B at the tail end 43 of the protrusion 35 becomes smaller than a gap A at the front end 44 of the protrusion 35.

Toner that has passed the openings 33 falls down to a passage indicated by an arrow 51 of FIG. 3. In this case, toner does not come into contact with the cleaning brush 21. Toner is falling down toward the toner collection auger 25, but since the toner collection auger 25 rotates in a direction (clockwise direction) of an arrow 52 of FIG. 3, toner falls down to a side (reference numeral 54) where a blade member 53 (see FIG. 3) of the toner collection auger 25 moves up, not aside (reference numeral 55) where the blade member 53 moves down, such that toner is not splashed by the toner collection auger 25.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the skilled in the art to understand the invention for various embodiments and with the various modifications as are suited to the particular use contemplated. It is intended that the scope of the invention be defined by the following claims and their equivalents.

What is claimed is:

1. A cleaning device comprising:

a rotary member that rotates in contact with an image carrier and moves materials on a surface of the image carrier along a rotation direction of the rotary member;

a scraping member that contacts with the rotary member to scrape the materials adhering onto the rotary member, the scraping member having a plurality of openings provided along an axial direction of the image carrier, through which the materials scraped by the scraping member pass to a collected material receiving portion;

the collected material receiving portion that receives the materials passed through the openings; and a protrusion portion that is arranged between the openings and the contact portion of the rotary member and the scraping member, and protrudes toward an upstream side in a rotation direction of the rotary member from a reference surface, and is positioned on an upper side in the gravity direction of the contact portion of the rotary member and the scraping member, wherein the reference surface is a virtual surface that passes through a contact portion of the rotary member and the scraping member, is parallel to a gravity direction, and is disposed between a contact portion of the image carrier and the rotary member, and the collected material receiving portion.

2. The cleaning device according to claim 1, wherein, at the contact portion of the rotary member and the scraping member, an angle between a tangential line on the surface of the rotary member and the surface of the protrusion facing the rotary member forms an acute angle.

3. The cleaning device according to claim 2, further comprising a cleaning blade disposed downstream of the image carrier with respect to the rotation direction, wherein the collected material receiving portion has a transporting member, and wherein a gap between the rotary member and a tail end of the protrusion portion is larger than a gap between the rotary member and a top end of the protrusion portion.

4. An image forming unit comprising:

an image carrier; and a cleaning unit that cleans materials on the image carrier, wherein the cleaning unit includes a rotary member that rotates in contact with an image carrier and moves materials on a surface of the image carrier along a rotation direction of the rotary member;

a scraping member that contacts with the rotary member to scrape the materials adhering onto the rotary member, the scraping member having a plurality of openings provided along an axial direction of the image carrier, through which the materials scraped by the scraping member pass to a collected material receiving portion;

the collected material receiving portion that receives the materials passed through the openings; and a protrusion portion that is arranged between the openings and the contact portion of the rotary member and the scraping member, and protrudes toward an upstream side in a rotation direction of the rotary member from a reference surface, and is positioned on an upper side in the gravity direction of the contact portion of the rotary member and the scraping member, wherein the reference surface is a virtual surface that passes through a contact portion of the rotary member and the scraping member, is parallel to a gravity direction, and is disposed between a contact portion of the image carrier and the rotary member, and the collected material receiving portion.

5. The image forming unit according to claim 4, wherein, at the contact portion of the rotary member and the scraping member, an angle between a tangential line on the surface of the rotary member and the surface of the protrusion facing the rotary member forms an acute angle.

6. The image forming unit according to claim 5, further comprising a cleaning blade disposed downstream of the image carrier with respect to the rotation direction, wherein the collected material receiving portion has a transporting member, and wherein a gap between the rotary member and a tail end of the protrusion portion is larger than a gap between the rotary member and a top end of the protrusion portion.

7. An image forming apparatus comprising:

an image carrier;

a developing unit that develops an electrostatic latent image on the image carrier with toner; and a cleaning unit that cleans materials on the image carrier, wherein the cleaning section includes a rotary member that rotates in contact with an image carrier and moves materials on a surface of the image carrier along a rotation direction of the rotary member;

a scraping member that contacts with the rotary member to scrape the materials adhering onto the rotary member, the scraping member having a plurality of openings provided along an axial direction of the image carrier, through which the materials scraped by the scraping member pass to a collected material receiving portion;

the collected material receiving portion that receives the materials passed through the openings; and a protrusion portion that is arranged between the openings and the contact portion of the rotary member and the scraping member, and protrudes toward an upstream side in a rotation direction of the rotary member from a reference surface, and is positioned on an upper side in the gravity direction of the contact portion of the rotary member and the scraping member, wherein the reference surface is a virtual surface that passes through a contact portion of the rotary member and the scraping member, is parallel to a gravity direction, and is disposed between a contact portion of the image carrier and the rotary member, and the collected material receiving portion.

8. The image forming apparatus according to claim 7, wherein, at the contact portion of the rotary member and the scraping member, an angle between a tangential line on the surface of the rotary member and the surface of the protrusion facing the rotary member forms an acute angle.

9. The image forming apparatus according to claim 8, further comprising a cleaning blade disposed downstream of the image carrier with respect to the rotation direction, wherein the collected material receiving portion has a transporting member, and wherein a gap between the rotary member and a tail end of the protrusion portion is larger than a gap between the rotary member and a top end of the protrusion portion.

* * * * *